US006001001A

United States Patent [19]

IslamRaja et al.

[11] Patent Number: 6,001,001

[45] Date of Patent: Dec. 14, 1999

[54] APPARATUS AND METHOD FOR CHEMICAL MECHANICAL POLISHING OF A WAFER

[75] Inventors: Mohammad IslamRaja, Allen; John D. Clark, Wylie, both of Tex.

[73] Assignee: Texas Instruments Incorporated, Dallas, Tex.

[21] Appl. No.: 09/093,869

[22] Filed: Jun. 9, 1998

Related U.S. Application Data

[60] Provisional application No. 60/049,256, Jun. 10, 1997.

[51] Int. Cl.[6] ..... B24B 29/02

[52] U.S. Cl. ..... 451/41; 451/246; 451/285; 451/287; 451/298

[58] Field of Search ..... 451/41, 246, 285, 451/287, 298

[56] References Cited

U.S. PATENT DOCUMENTS

| | | | |
|---|---|---|---|
| 5,779,526 | 7/1998 | Gill | 451/324 |
| 5,842,910 | 12/1998 | Krywanczyk | 451/41 |
| 5,851,140 | 12/1998 | Barns | 451/288 |
| 5,876,273 | 3/1999 | Yano | 451/288 |

*Primary Examiner*—Patricia A. Short
*Attorney, Agent, or Firm*—Jacqueline J. Garner; Wade James Brady; Richard L. Donaldson

[57] ABSTRACT

In a polishing configuration wherein a polishing material or slurry is applied to a surface of a rotating polishing pad and a product material mounted on a rotating carrier is moved into contact with the polishing material or slurry, the flow of the polishing material or slurry over the surface can be improved by fabricating spiral grooves or channels in the surface of the polishing pad and by mounting the product material is a cavity of the carrier, the cavity having grooves or channels in the side walls to provide a uniform flow over the product material. The angle between the spiral grooves or channels on the polishing pad and a diameter about the axis of rotation should be approximately 40°. The spiral grooves or channels on the polishing pad can be combined with concentric grooves or channels to further improve the flow of polishing material. Similarly, the grooves or channels in the rotating carrier provide further uniformity for the interaction of the polishing material and the product material. As with the grooves or channels in the polishing pad, the grooves or channels in the side walls of the carrier cavity have an optimum angle of 40° with respect to the diameter, centered on the axis of rotation of the carrier, passing through the groove or channel.

6 Claims, 3 Drawing Sheets

APPARATUS AND METHOD FOR CHEMICAL MECHANICAL POLISHING OF A WAFER

This application claims priority under 35 USC §119(e) (1) of provisional application Ser. No. 60/049,256 filed Jun. 10, 1997.

RELATED APPLICATIONS

U.S. provisional patent application Ser. No. 60/049,115, filed Jun. 10, 1997, U.S. provisional patent application Ser. No. 60/049,133, filed Jun. 10, 1997, filed on even date with the present application, are related patent applications.

BACKGROUND OF THE INVENTION

1. Field of the Invention

This invention relates to generally to the chemical mechanical polishing of the product material and, more particularly, to the chemical mechanical polishing of device material during the fabrication of semiconductor devices. In order to provide uniform polishing, the polishing material or slurry must be uniformly distributed over the polishing pad and over the product material being processed.

2. Description of the Related Art

Referring to FIG. 1A and FIG. 1B, a top view and side view, respectively, of the arrangement of the polishing apparatus according to the prior art is shown. A polishing pad 10 rotates with an angular velocity $\omega_p$ is shown. A tube 15 having an outlet port at or near the center of rotation of the polishing pad 10. A polishing material or slurry 19 is transmitted through the tube and deposited on the polishing pad at or near the center of rotation of the polishing pad. The polishing material is distributed over the surface of the polishing pad 10. Product carriers 11, rotating with an angular velocity $\omega_c$ have a piece of the product material 16 attached to an first end. The rotating carrier 11 is lowered until the product material 16 comes in contact with the polishing material 19. The mechanical and/or chemical properties of polishing material 19, as it contacts the product material results in a polished surface on the product material 16.

The uniform polishing of the product material(s) 16 requires a uniform distribution of the polishing material 19. In the past, concentric grooves or channels 101 have been fabricated in the pad 10 to make the distribution of polishing material more uniform. While this geometry of the channels provided an improvement in the polishing process, more stringent requirements for product material surfaces have resulted in this channel geometry no longer providing a satisfactory polished surface.

A need has therefore been felt for a technique for improving the distribution of the polishing material over the pad and over the product material during the polishing process.

SUMMARY OF THE INVENTION

The aforementioned and other features are accomplished, according to the present invention, by fabricating spiral grooves or channels in the polishing pad. For optimum efficiency in the polishing process, the spiral grooves or channels have a predetermined angle with the circumferential velocity of the polishing pad. In the preferred embodiment, both spiral grooves or channels and circumferential grooves or channels are used.

These and other features of the present invention will be understood upon the reading of the following description in conjunction with the Figures.

BRIEF DESCRIPTION OF THE DRAWINGS

FIG. 1A is top view of the arrangement of apparatus for polishing a product material according to the prior art, while

FIG. 4A is a cross-sectional view of a product carrier according to the present invention, while

DESCRIPTION OF THE PREFERRED EMBODIMENT(S)

Detailed Description of the Drawings

Figure 1A:
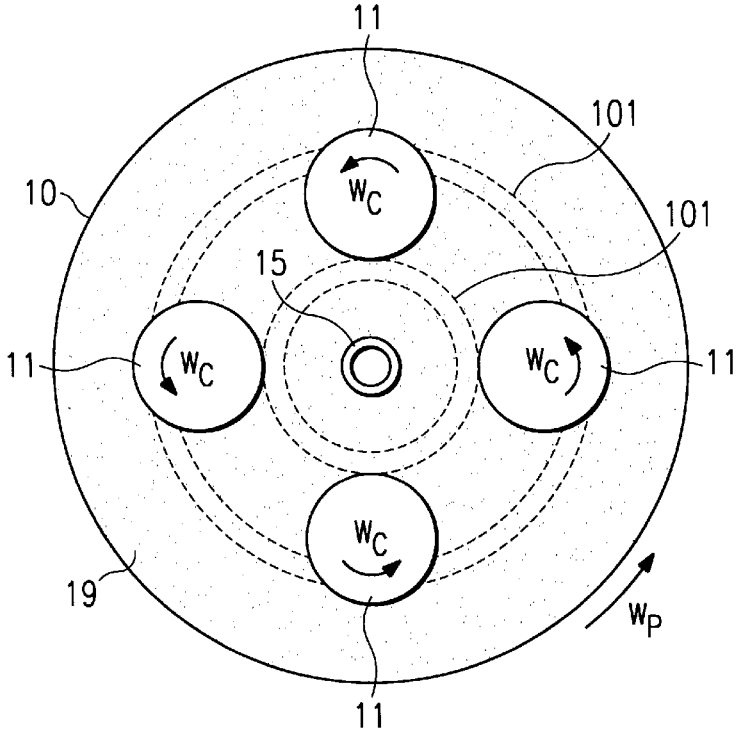
Figure 1B:
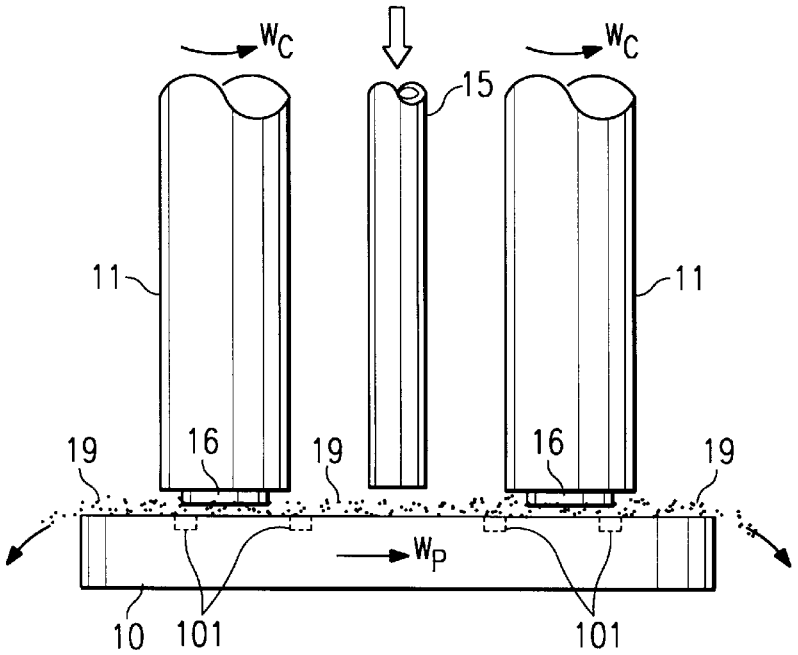
FIG. 1B is a side view of the apparatus arrangement of FIG. 1A.

FIG. 1A and FIG. 1B have been discussed with respect to the prior art.

Figure 2:
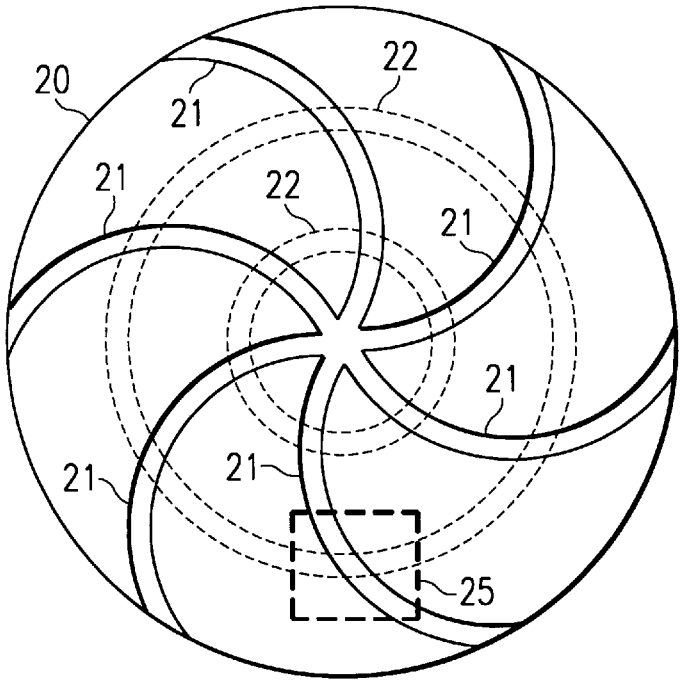
FIG. 2 is top view of the grooves or spirals fabricated in the polishing pad according to the present invention.

Referring next to FIG. 2, a top view of the polishing pad 20 according to the present invention is shown. The polishing pad 20 has spiral grooves or channels 21 fabricated in the surface upon which the polishing material flows. In the preferred embodiment, the polishing pad 20 also has grooves or channels fabricated therein which are generally concentric to the axis of rotation of the polishing pad 20.

Figure 3:
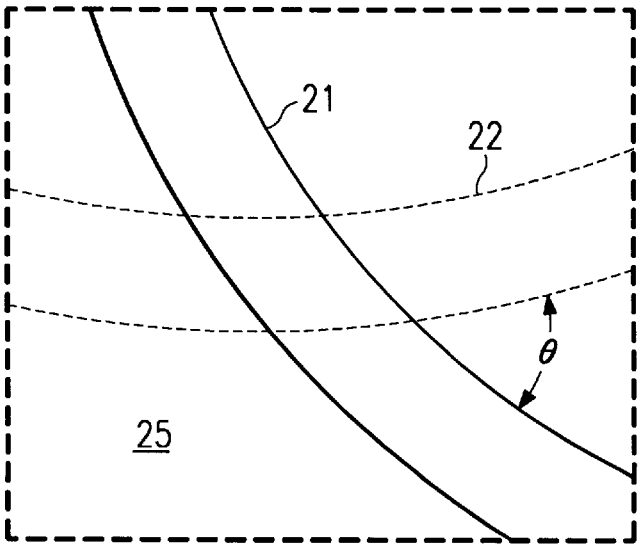
FIG. 3 is an expanded top view of a portion of the polishing pad illustrating the optimum configuration grooves or channels according to the present invention.

Referring to FIG. 3, an enlarged portion 25 of the polishing pad 20 of FIG. 2 is shown. A spiral groove or channel 21 intersects with a concentric groove or channel 22. The spiral groove 21 makes an angle of $\phi$ with a diameter about the axis of rotation (as illustrated by the concentric groove 22).

Figure 4A:
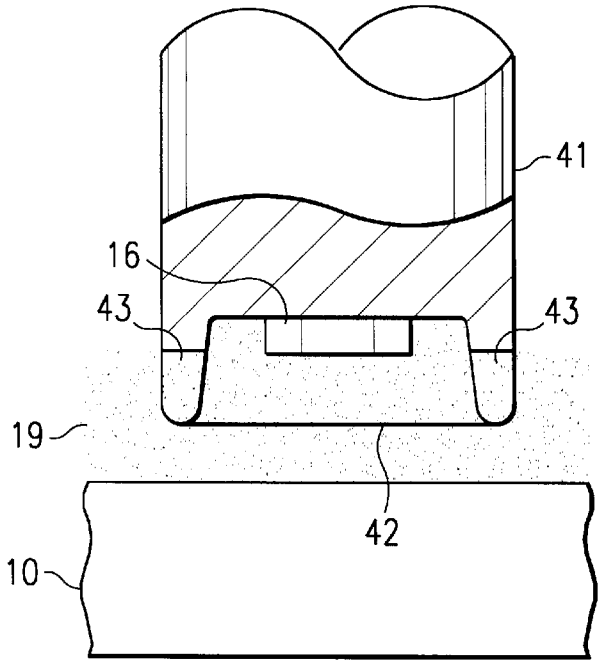
Figure 4B:
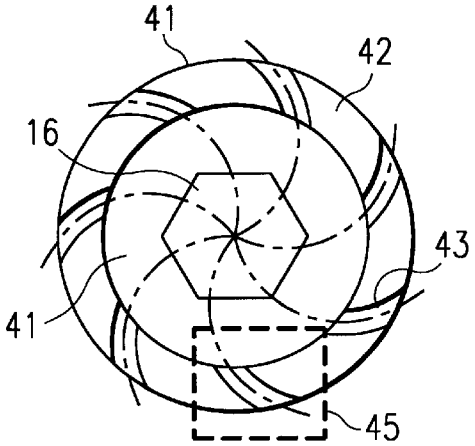
FIG. 4B is a bottom view of a product carrier.

Referring to FIG. 4A, a cross-sectional view of the product carrier 41, according to the present invention is shown. The product carrier 41 has a rim 42 extending from the lower circumference of product carrier 41. This rim 42 forms a cavity in the lower portion of the product carrier 41. The product material 16 is attached to product carrier within the cavity. The rim 42 has grooves or channels 43 formed therein. In FIG. 4B, a bottom view of the product carrier 41, according to the present invention, is shown. The product material 16 is attached in the cavity formed by the bottom of the product carrier 41 and the rim 42. The grooves or channels 43 are formed in rim 42.

Figure 5:
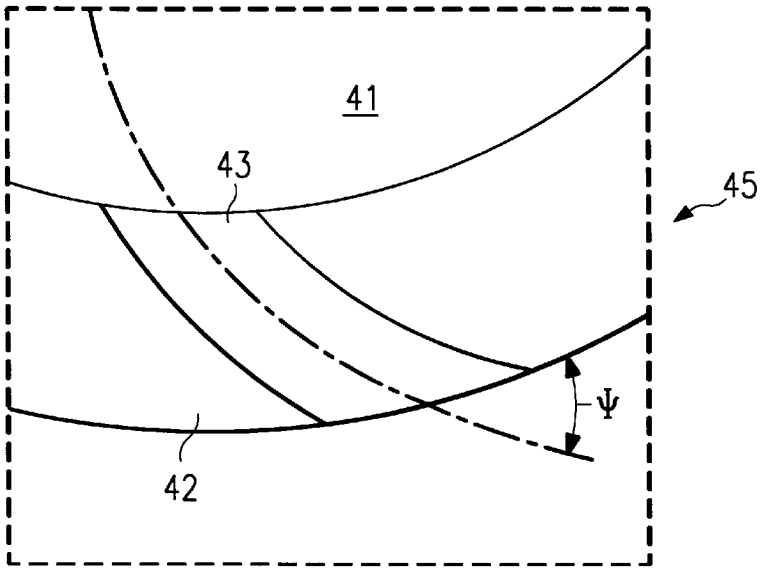
FIG. 5 is an expanded portion of the bottom view of the product carrier.

Referring to FIG. 5, a portion 45 of FIG. 4B as been enlarged. A groove or channel 43 is formed in the rim 42 of product carrier 41. The groove or channel 43 is formed at an angle $\Psi$ with respect to the rim 43, i.e. with respect to the circumference about the axis of rotation of the product carrier 41.

Operation of the Preferred Embodiment(s)

In the chemical mechanical polishing of a material, the flow of the polishing material relative to the product material must be relatively uniform to provide an acceptable polishing operation. The presence of the grooves or channels influences the flow of the polishing material over the polishing pad surface. The present invention uses spiral grooves or channels in the polishing pad to direct the flow of the polishing material. The optimum flow uniformity occurs when the angle between a spiral groove and a diameter about an axis of rotation (as indicated by the concentric groove or channel) is found to be $\phi$=39.6°. However, this angle is not critical and the angle $\phi$ may vary between $\phi$=55° and $\phi$=25° and still provide an improvement in the polishing operation.

In addition, the attachment of the product material in a cavity in the product carrier, along with the grooves or channels formed in the rim creating the carrier, provide a more uniform flow of polishing material past the surface of the product material. Once again, it has been found that the optimum polishing uniformity is achieved when $\Psi=39.6°$. Once again, an improvement in the polishing of the product material can be found for groove or channel angles in the rim ranging from $\Psi=55°$ and $\Psi=30°$.

While the invention has been described with particular reference to the preferred embodiment, it will be under stood by those skilled in the art that various changes may be made and equivalents substituted for elements of the preferred embodiment without departing from the invention. In addition, many modifications may be made to adapt a particular situation and material to a teaching of the present invention without departing from the essential teachings of the present invention.

As is evident from the foregoing discussion, certain aspects of the invention are not limited to the particular details of the examples illustrated, and it is therefore contemplated that other modifications and applications will occur to those skilled in the art. It is accordingly intended that the claims shall cover all modifications and applications as do not depart from the spirit and scope of the invention.

What is claimed is:

1. An improved product carrier of the type used in a chemical mechanical polishing operation, the polishing operation of the type having polishing material applied to a surface of a rotating polishing pad and a product material attached to a product carrier and placed in contact with said polishing material, wherein the improvement is characterized by:

said product carrier having cavity in a bottom portion wherein said product material is attached, said cavity having grooves or channels formed in sides of said cavity.

2. The product carrier of claim 1 wherein said grooves or channels have an angle of approximately 40° with respect to a diameter about an axis of rotation.

3. An improved method of polishing a product material in a configuration wherein a polishing material or slurry is applied to a central surface region of a rotating polishing pad and said product material is attached to a rotating product carrier and brought into contact with said polishing material or slurry, wherein said improvement is characterized by the steps of:

attaching said product material in a cavity in a portion of said product carrier to be inserted in said polishing material; and forming groves or channels in sides of said cavity.

4. The method of claim 3 wherein said forming step further includes the step of forming said grooves or channels in said sides of said cavity such that said grooves or channels have an angle of approximately 40° with diameters, about an axis of rotation of said material carrier, passing through said grooves or channels.

5. A polishing configuration for chemical mechanical polishing of a product material, said configuration comprising:

a polishing pad, said polishing pad having a polishing material applied thereto during rotation of said polishing pad; and a product carrier having said product material attached thereto for insertion of said product material into said polishing material on said polishing pad, said product carrier having a cavity formed therein wherein said product material is attached, said cavity having grooves/channels formed in sides thereof.

6. The polishing configuration of claim 5 wherein said polishing pad further has spiral grooves/channels formed in said surface thereof.

* * * * *